US010562325B2

(12) United States Patent
Takenaka et al.

(10) Patent No.: US 10,562,325 B2
(45) Date of Patent: Feb. 18, 2020

(54) LIQUID DISCHARGE APPARATUS

(71) Applicant: SEIKO EPSON CORPORATION, Tokyo (JP)

(72) Inventors: Ryota Takenaka, Matsumoto (JP); Mikio Kitagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/945,475

(22) Filed: Apr. 4, 2018

(65) Prior Publication Data

US 2018/0290466 A1 Oct. 11, 2018

(30) Foreign Application Priority Data

Apr. 7, 2017 (JP) ..... 2017-077036

(51) Int. Cl.

| | |
|---|---|
| ***B41J 13/14*** | (2006.01) |
| ***B41J 13/00*** | (2006.01) |
| ***B65H 18/14*** | (2006.01) |
| ***B41J 11/00*** | (2006.01) |
| ***B41J 13/10*** | (2006.01) |
| ***B41J 11/06*** | (2006.01) |
| ***B65H 23/28*** | (2006.01) |

(52) U.S. Cl.

CPC ..... *B41J 13/0009* (2013.01); *B41J 11/0085* (2013.01); *B41J 11/06* (2013.01); *B41J 13/106* (2013.01); *B41J 13/14* (2013.01); *B65H 18/145* (2013.01); *B65H 23/28* (2013.01); *B65H 2404/5211* (2013.01); *B65H 2801/06* (2013.01)

(58) Field of Classification Search

CPC ..... B41J 13/0009; B41J 13/14; B41J 13/106; B41J 11/0085; B41J 11/06; B41J 2/01; B65H 18/145; B65H 18/16; B65H 23/28; B65H 2404/5211; B65H 2801/06

See application file for complete search history.

(56) References Cited

U.S. PATENT DOCUMENTS 6,038,776 A * 3/2000 Yamada ..... B41J 11/0085 271/183
6,752,553 B2 * 6/2004 Fujioka ..... B41J 11/0005 271/188

(Continued)

FOREIGN PATENT DOCUMENTS

JP 2003-246524 A 9/2003

*Primary Examiner* — Yaovi M Ameh

(74) *Attorney, Agent, or Firm* — Workman Nydegger

(57) ABSTRACT

There is provided a liquid discharge apparatus including: a transporting unit that transports a medium in a transporting direction, a discharge portion that discharges a liquid to the medium positioned in a discharge range, and a supporting portion that has a first supporting surface and a second supporting surface, as a supporting surface supporting the medium to be transported by the transporting unit, in which the first supporting surface supports the medium in the discharge range and does not have unevenness in a width direction intersecting the transporting direction, the second supporting surface supports the medium on a downstream side of the discharge range in the transporting direction and includes uneven portions in which a first portion and a second portion which is further recessed than the first portion are formed alternately in the width direction.

7 Claims, 10 Drawing Sheets

(56) References Cited

U.S. PATENT DOCUMENTS

| | | | | |
|---|---|---|---|---|
| 2002/0126190 | A1* | 9/2002 | Juan | B41J 11/0085 347/102 |
| 2003/0084811 | A1 | 5/2003 | Ishii et al. | |
| 2003/0085978 | A1 | 5/2003 | Ishii et al. | |
| 2003/0085980 | A1 | 5/2003 | Ishii et al. | |
| 2004/0263601 | A1 | 12/2004 | Ishii et al. | |
| 2006/0250473 | A1 | 11/2006 | Ishii et al. | |
| 2008/0180504 | A1 | 7/2008 | Ishii et al. | |
| 2010/0134578 | A1 | 6/2010 | Ishii et al. | |
| 2011/0074872 | A1* | 3/2011 | Ozaki | B41J 2/16523 347/30 |
| 2011/0221843 | A1* | 9/2011 | Ozaki | B41J 11/0065 347/104 |

* cited by examiner

LIQUID DISCHARGE APPARATUS

BACKGROUND

1. Technical Field

The present invention relates to a liquid discharge apparatus.

2. Related Art

In the related art, various liquid discharge apparatuses are used. Among the various liquid discharge apparatuses, there is a liquid discharge apparatus that supports a medium to be transported on a supporting surface of a supporting portion and discharges a liquid onto the medium supported on the supporting surface to form an image.

For example, JP-A-2003-246524 discloses an ink jet printer (liquid discharge apparatus) which supports a recording paper as a medium on a recording medium transporting surface (supporting surface) and discharges ink as a liquid onto the recording paper supported on the recording medium transporting surface.

In the liquid discharge apparatus in the related art that supports the medium to be transported on the supporting surface, there is a case where the medium is floated from the supporting surface and come into contact with the discharge portion of the liquid. Therefore, JP-A-2003-246524 describes that a recess is provided on the recording medium transporting surface, and a wavy bulge (cockling) of the medium is released to the recess.

However, in the ink jet printer disclosed in JP-A-2003-246524, a plurality of recesses are also formed at positions facing the recording head (discharge portion), and ink is discharged onto the recessed medium corresponding to the recesses, the landing position of the ink is shifted according to the deformation of the medium caused by the recess and the image quality sometimes decreases.

SUMMARY

An advantage of some aspects of the invention is to suppress decrease in an image quality according to floatation of a medium to be transported from a supporting surface and deformation of the medium.

According to an aspect of the invention, there is provided a liquid discharge apparatus including: a transporting unit that transports a medium in a transporting direction, a discharge portion that discharges a liquid to the medium positioned in a discharge range, and a supporting portion that has a first supporting surface and a second supporting surface, as a supporting surface supporting the medium to be transported by the transporting unit, in which the first supporting surface supports the medium in the discharge range and does not have unevenness in a width direction intersecting the transporting direction, the second supporting surface supports the medium on a downstream side of the discharge range in the transporting direction and includes uneven portions in which a first portion and a second portion which is further recessed than the first portion are formed alternately in the width direction.

Here, "does not have unevenness" is not limited to the fact that the first supporting surface is strictly flat in the width direction, but is used in a meaning that it is a surface shape enough to say that there is no substantial influence on image quality even if the medium is deformed by own weight thereof or external force such as suction force on the first supporting surface.

In this configuration, the liquid discharge apparatus has the first supporting surface in which the unevenness is not formed in the width direction corresponding to the discharge range and the second supporting surface which includes the uneven portions alternately formed in the width direction. Therefore, the medium supported by the first supporting surface corresponding to the discharge range can be kept to be flat while suppressing the floatation of the medium from the supporting surface at the second supporting surface. Therefore, the floatation of the medium to be transported from the supporting surface and the decrease in the image quality due to the deformation of the medium can be suppressed.

In the liquid discharge apparatus, a downstream side of the second portion in the transporting direction may be opened.

In this configuration, since the downstream side of the second portion is opened in the transporting direction, the floatation of the medium to the downstream side in the transporting direction can be released, for example, by a decrease in wrinkles occurring in the medium or the like.

The "downstream side is opened" means that it includes not only a structure which is nothing configured at the downstream side but also a structure having a structure object in a partial region on the downstream side, or a structure in which a structure having a structure object lower than the first portion on the entire downstream side, and the like, that is, it means that it can be a structure which can release the floatation of the medium (for example, decrease in wrinkles).

The liquid discharge apparatus may further include a bent portion which is bent in a direction away from the discharge portion on a downstream side of the second portion in the transporting direction in a transporting path of the medium.

In this configuration, since the bent portion bent in the direction away from the discharge portion is provided on the downstream side of the second portion in the transporting direction in the transporting path of the medium, the floatation of the medium is crushed by the medium being bent through the bent portion, and floatation of the medium can be particularly effectively suppressed.

In the liquid discharge apparatus, the length of the second portion in the width direction may be longer than the length thereof in the transporting direction.

In this configuration, since the length of the second portion in the width direction is longer than the length thereof in the transporting direction, even in a case where a medium is used which is unlikely to produce fine unevenness in the width direction, the floatation of the medium can be effectively released and the floatation of the medium can be particularly effectively suppressed.

In the liquid discharge apparatus, the height of the first portion and the height of the first supporting surface may be flush with each other.

Although, when the height of the first portion is made higher than the height of the first supporting surface, the medium to be transported is likely to be hooked between the first supporting surface and the second supporting surface, according to this configuration, since the height of the first portion and the height of the first supporting surface are flush with each other, it is possible to increase the difference in height between the first portion and the second portion while suppressing the hooking of the medium. Therefore, the floatation of the medium can be effectively released, and the floatation of the medium can be particularly effectively suppressed.

The "height" means the position in the direction intersecting the supporting surface and means that it is not limited to the position in the vertical direction.

In a liquid discharge apparatus, the first supporting surface may be adjacent to the uneven portion in the transporting direction.

In this configuration, since the first supporting surface is adjacent to the uneven portion in the transporting direction, the floatation of the medium on the downstream side of the first supporting surface immediately in the transporting direction corresponding to the discharge range can be released and the floatation of the medium can be particularly effectively suppressed.

In a liquid discharge apparatus, the first supporting surface and the second supporting surface may be respectively provided with suction holes for sucking the medium and the suction hole formed in the second supporting surface may be larger than the suction hole formed in the first supporting surface.

In this configuration, since the suction holes for sucking the medium are respectively formed on the first supporting surface and the second supporting surface, floatation of the medium can be effectively suppressed by the first supporting surface and the second supporting surface. In addition, by making the suction hole formed in the second supporting surface larger than the suction hole formed in the first supporting surface, floatation of the medium can be particularly effectively suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus as a liquid discharge apparatus according to an example of the invention will be described in detail with reference to the accompanying drawings.

Example 1 (FIGS. 1 to 12)

First, an overview of a printing apparatus according to Example 1 of the invention will be described.

Figure 1:
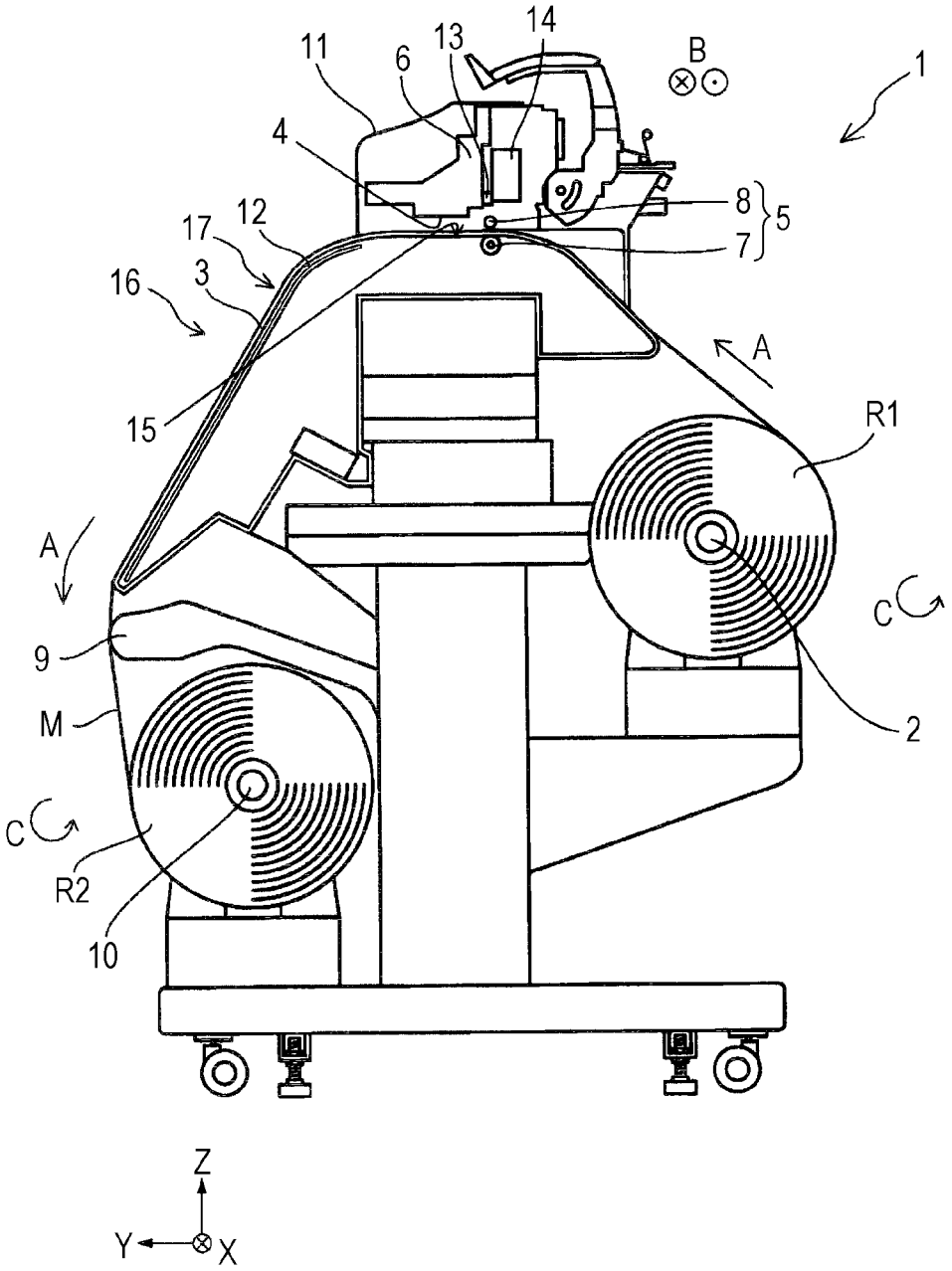
FIG. 1 is a schematic side view illustrating a printing apparatus according to Example 1 of the invention.

FIG. 1 is a schematic side view illustrating a printing apparatus 1 according to this example.

The printing apparatus 1 of this example is provided with a supporting shaft 2 for supporting a roll R1 of a rolled medium M for performing printing. In the printing apparatus 1 of this example, when the medium M is transported in the transporting direction A, the supporting shaft 2 rotates in a rotation direction C. In this example, although a rolled medium M wound so that the printed surface thereof faces outward is used, in a case where a rolled medium M wound so that the printed surface thereof faces inward is used, it is possible to rotate in the reverse direction to the rotation direction C of the supporting shaft 2 and to feed out the roll R1.

In this example, although rolled transfer paper for sublimation transfer is used as the medium M, the type, the shape, or the like of the medium M to be used are not particularly limited.

In addition, the printing apparatus 1 of this example is provided with a supporting portion 17 having a supporting surface 3 for supporting the medium M. The supporting portion 17 and the like constitute a transporting path 16 of the medium M. In addition, the printing apparatus 1 includes a transporting roller pair 5 including a driving roller 7 and a driven roller 8 for transporting the medium M in the transporting direction A in the transporting path 16. The transporting roller pair 5 functions as a transporting unit that transports the medium M in the transporting direction A. The detailed configuration of the supporting portion 17 which is a main portion of the printing apparatus 1 of this example will be described below.

In the printing apparatus 1 of this example, the driving roller 7 is configured with a roller extending in the width direction B intersecting the transporting direction A and a plurality of the driven roller 8 are provided side by side with respect to the driving roller 7 at a position facing the driving roller 7 in the width direction B.

A heater 12 is provided under the supporting portion 17, as a heating unit that can heat the medium M supported by the supporting surface 3. As described above, although the printing apparatus 1 of this example includes the heater that can heat the medium M from a side of the supporting portion 17 as the heating unit, an infrared heater or the like may be provided at a position facing the supporting portion 17 (supporting surface 3).

In addition, the printing apparatus 1 of this example includes a head 4 that serves as a discharge portion for discharging ink as a liquid from the nozzles of the nozzle forming surface provided with a plurality of nozzles in the housing portion 11, and a carriage 6 on which the head 4 is mounted and that can reciprocate in the width direction B.

In the printing apparatus 1 of this example, the transporting direction A in the discharge range 15, which is a position facing the head 4 (nozzle forming surface) on the supporting surface 3, is a direction along a direction Y which is a horizontal direction, the width direction B of the head 4 is a direction along a direction X orthogonal to the direction Y which is a horizontal direction, and the ink discharge direction is a direction (vertically downward direction) along a direction Z which is a vertical direction.

Here, inside the housing portion 11, a frame 14 is formed, and a guide rail 13 attached to the frame 14 and extending in the direction X is formed. The carriage 6 provided with the head 4 is attached to the guide rail 13.

With the configuration described above, the head 4 can print an image by discharging ink from a nozzle (not illustrated) to the medium M to be transported while reciprocating in the width direction B intersecting the transporting direction A. By including the head 4 having such a configuration, the printing apparatus 1 according to this example can forms a desired image on the medium M, by repeating operations that the printing apparatus 1 transports the medium M in the transporting direction A by a predetermined amount (for one pass) and discharges the ink while the head 4 is moved in the width direction B in a state where the medium M is stopped.

Although the printing apparatus 1 of this example is a so-called serial printer that performs printing by alternately repeating transporting of a medium M and scanning (reciprocating movement) of a head 4, the printing apparatus 1 may be a so-called line printer in which continuous printing is performed while continuously transporting the medium M by using a line head in which nozzles are formed in a form of a line along the width direction B of the medium M.

In addition, a take-up shaft 10 that can wind the medium M as a roll R2 is provided on the downstream side of the head 4 in the transporting direction A. In this example, since the medium M is wound so that the printing surface faces outward, the take-up shaft 10 rotates in the rotation direction C when winding up the medium M. On the other hand, in a case of winding up so that the printed surface faces inward, it is possible to wind up by rotating the take-up shaft 10 in the reverse direction to the rotating direction C.

In addition, a tension bar 9 in which a contact portion with the medium M can extend in the width direction B and which can apply a desired tension to the medium M is provided between an end portion on the downstream side of the supporting portion 17 in the transporting direction A and the take-up shaft 10.

Next, the supporting portion 17 which is a main portion of the printing apparatus 1 of this example will be described.

Figure 2:
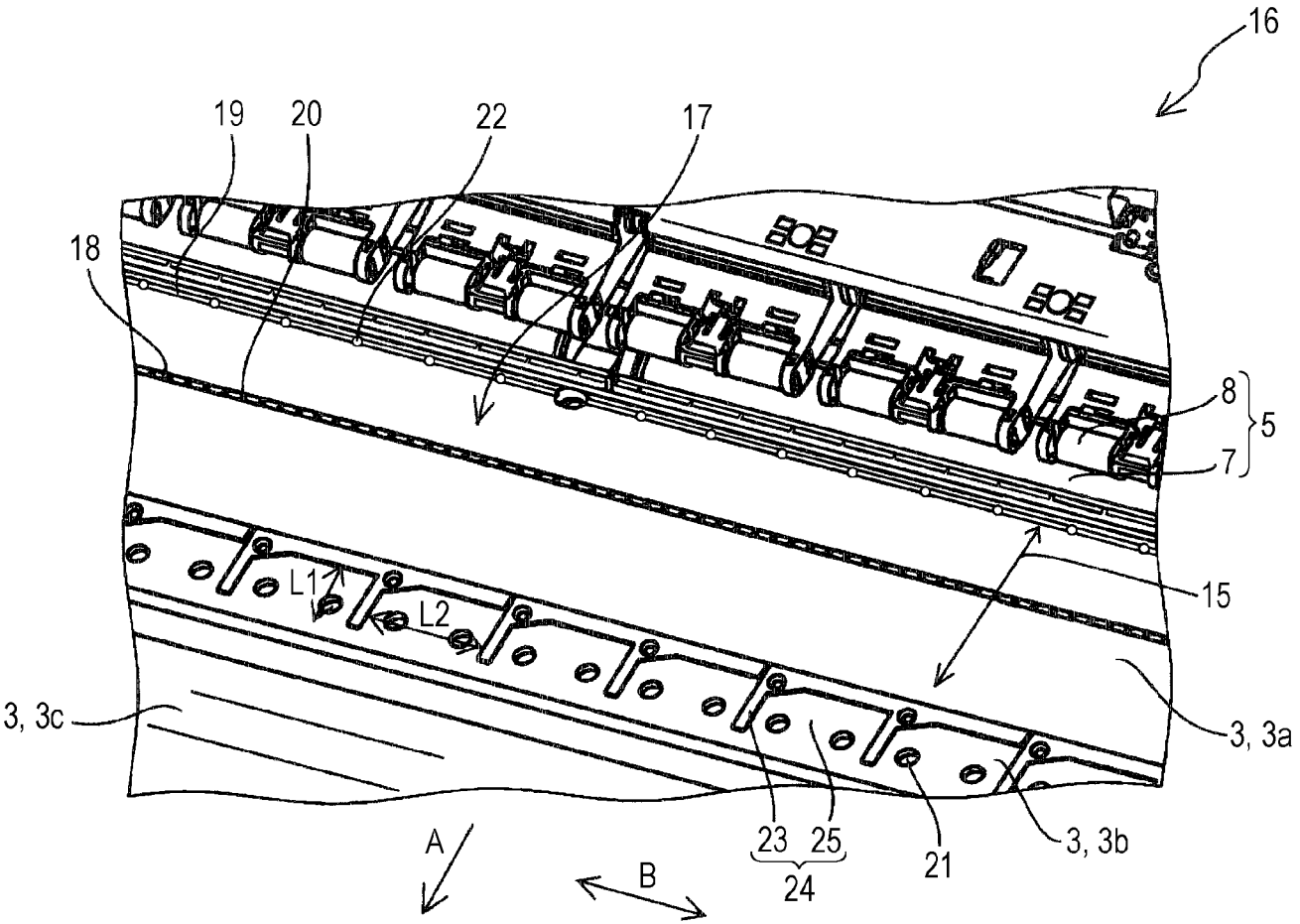
FIG. 2 is a perspective view illustrating a main portion of the printing apparatus according to Example 1 of the invention.
Figure 3:
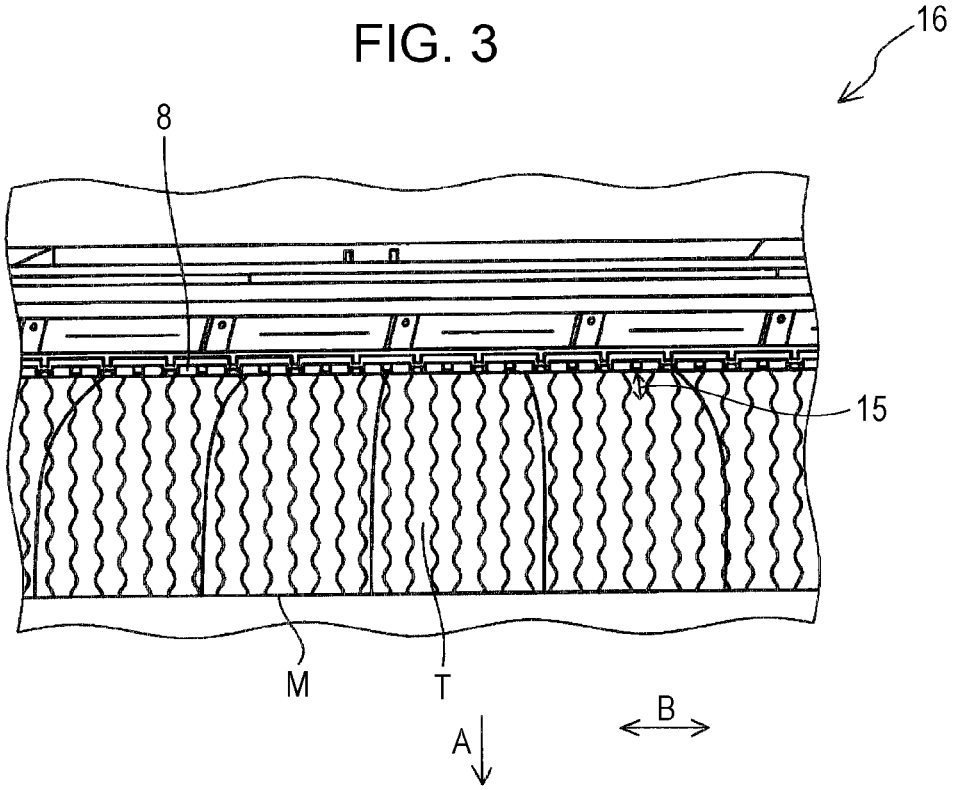
FIG. 3 is a perspective view illustrating a main portion of the printing apparatus according to Example 1 of the invention.
Figure 4:
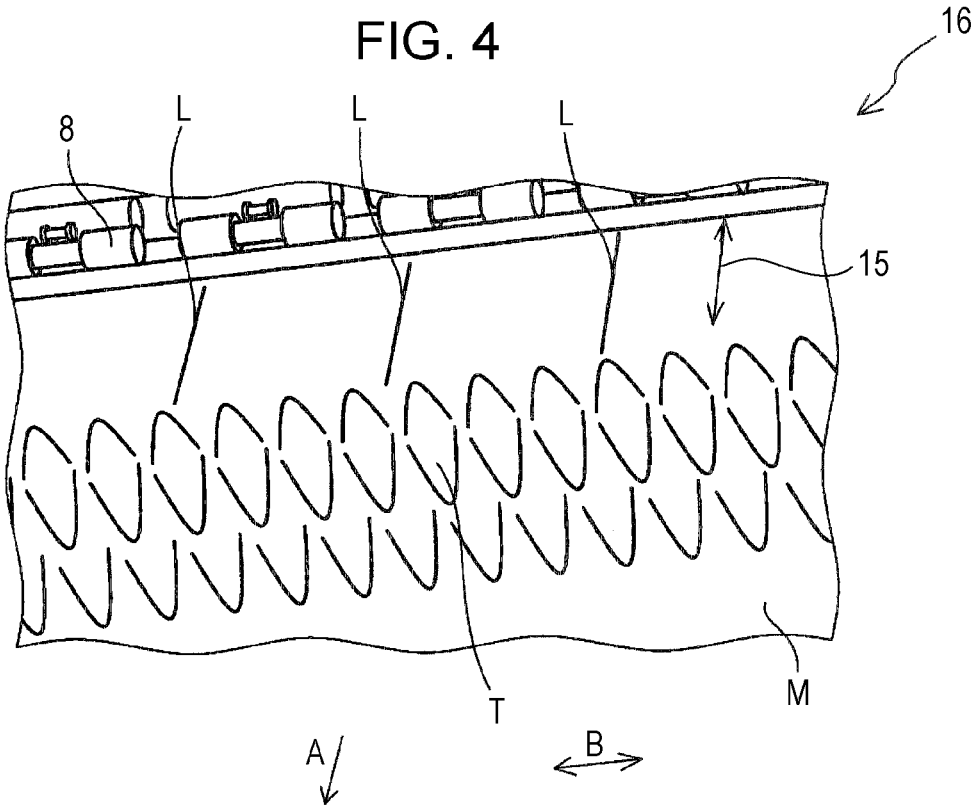
FIG. 4 is a perspective view illustrating a main portion of the printing apparatus according to Example 1 of the invention.

Here, FIG. 2 is a perspective view illustrating the periphery of a discharge range 15 of the supporting portion 17 which is a main portion of the printing apparatus 1 of this example, and illustrates a state where the medium M is not set in the transporting path 16. In addition, FIG. 3 is a perspective view illustrating the periphery of the discharge range 15 of the supporting portion 17 which is a main portion of the printing apparatus 1 of this example, and illustrates a state where the medium M is set in the transporting path 16. In addition, FIG. 4 illustrates a state where the medium M is set in the transporting path 16 in the printing apparatus 1 of this example, is a perspective view seen from a direction different from that in FIG. 3, and illustrates a state enlarged as compared with FIG. 3.

Figure 14:
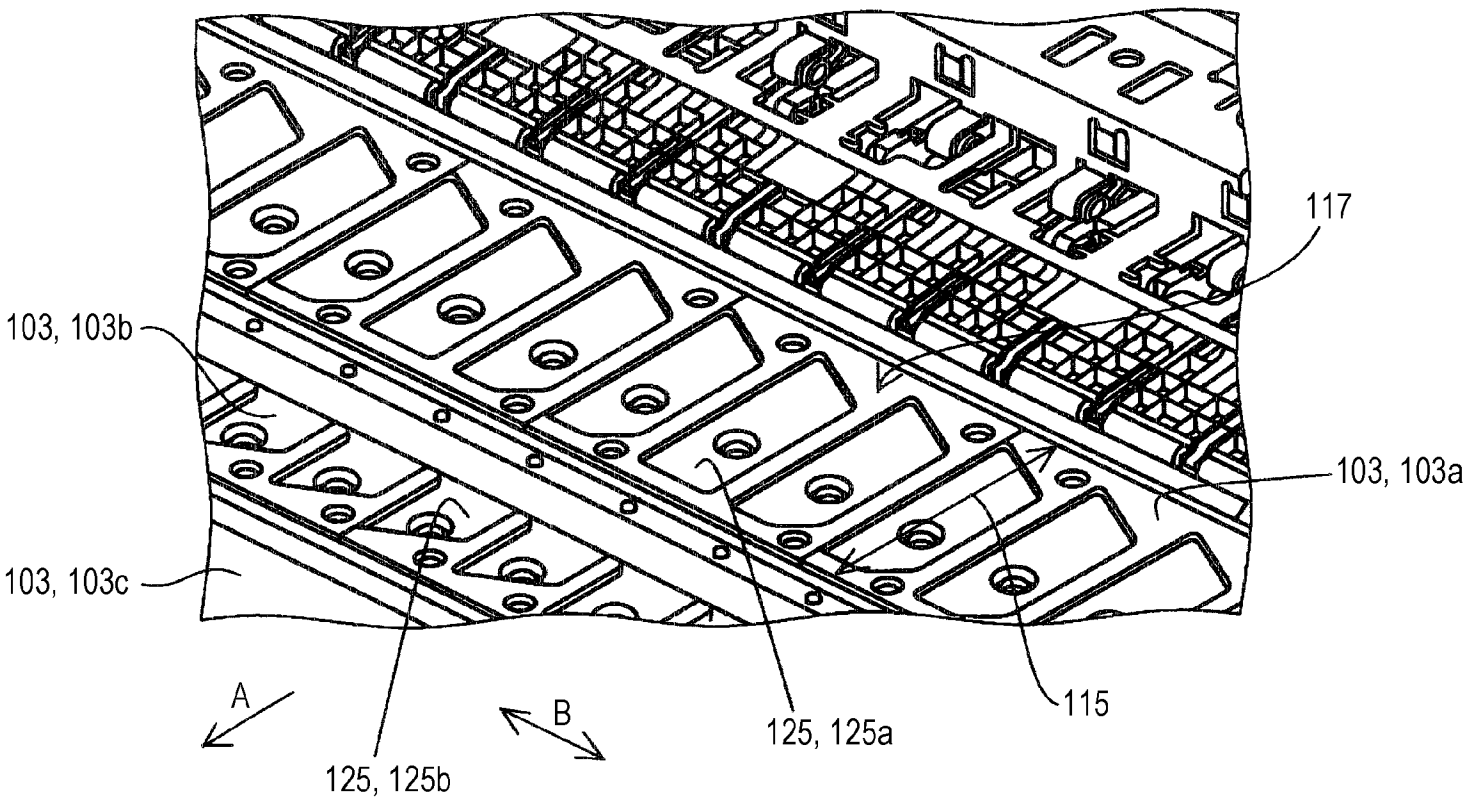
FIG. 14 is a perspective view illustrating the main portion of a printing apparatus of a reference example.
Figure 15:
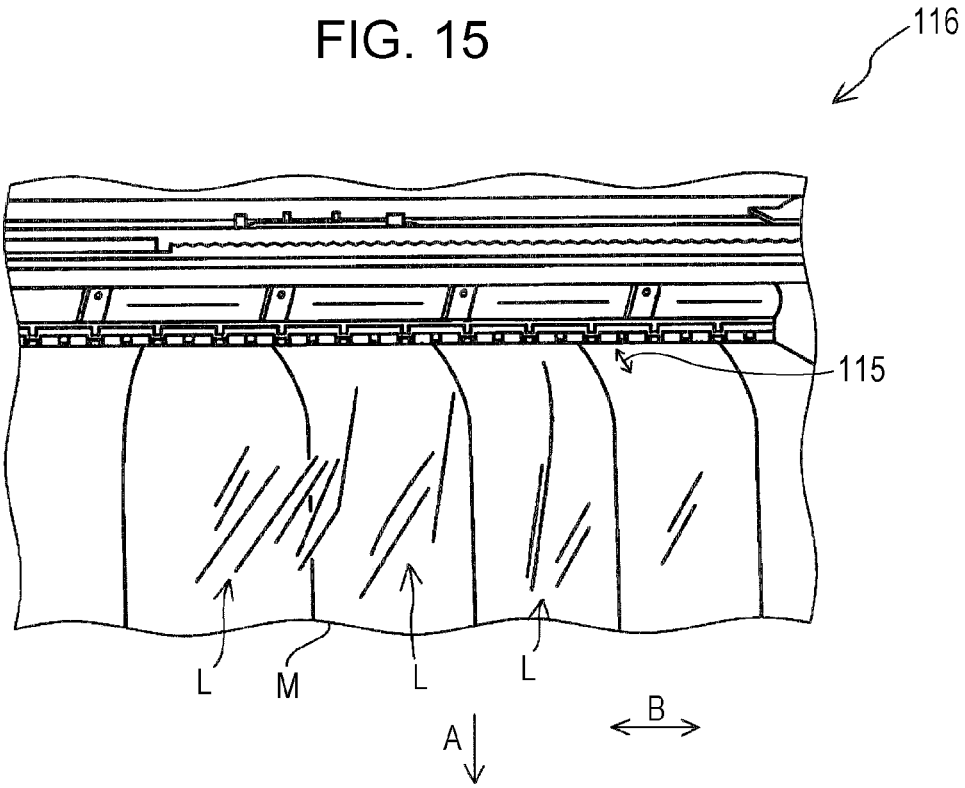
FIG. 15 is a perspective view illustrating the main portion of the printing apparatus of a reference example.
Figure 16:
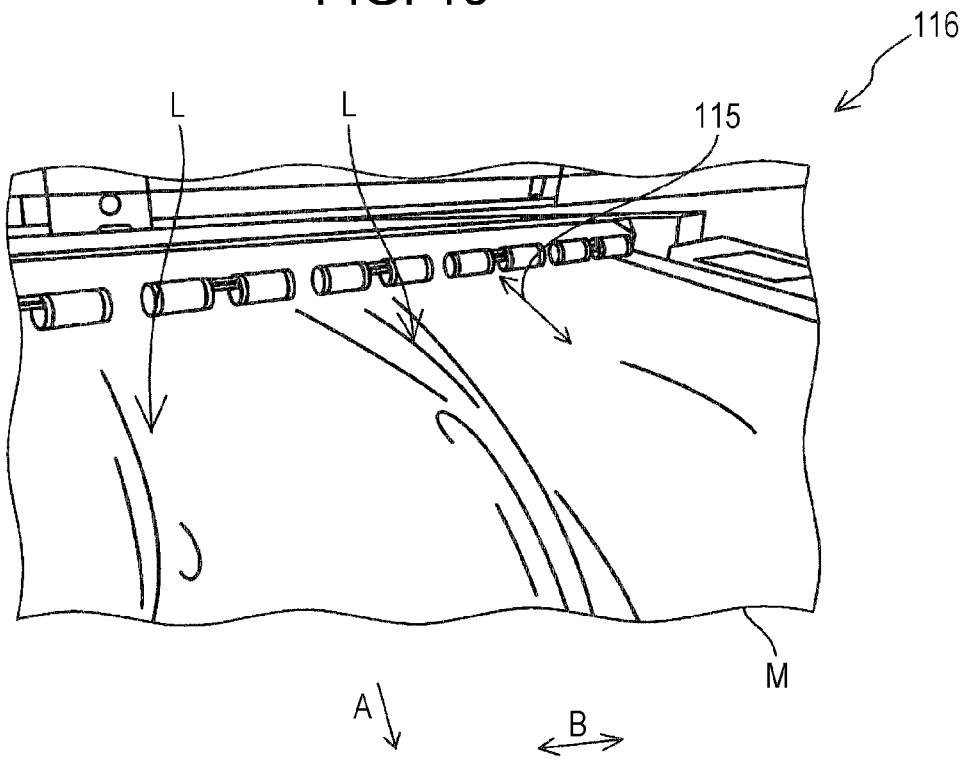
FIG. 16 is a perspective view illustrating the main portion of the printing apparatus of a reference example.

On the other hand, FIG. 14 is a view corresponding to FIG. 2, is a perspective view illustrating the periphery of the discharge range 115 of the supporting portion 117 of the printing apparatus of a reference example and illustrates a state where the medium M is not set in the transporting path 116. In addition, FIG. 15 is a view corresponding to FIG. 3, is a perspective view illustrating the periphery of the discharge range 115 of the supporting portion 117 which is a main portion of the printing apparatus of the reference example, and illustrates a state where the medium M is set in the transporting path 116. In addition, FIG. 16 is a view corresponding to FIG. 4, illustrates a state where the medium M is set in the transporting path 116 in the printing apparatus of the reference example, is a perspective view seen from a direction different from that in FIG. 15, and illustrates a state enlarged as compared with FIG. 15.

As illustrated in FIG. 14, the printing apparatus of the reference example has a first supporting surface 103*a*, a second supporting surface 103*b*, and a third supporting surface 103*c* as the supporting surface 103 at a position of the discharge range 115. The first supporting surface 103*a* is formed by arranging a plurality of recessed portions 125 (recessed portions 125*a*) side by side in the width direction B. In addition, the second supporting surface 103*b* is formed by arranging a plurality of recessed portions 125 (recessed portions 125*b*) side by side in the width direction B on the downstream side in the transporting direction A of the first supporting surface 103*a*. The third supporting surface 103*c* is a bent portion which is bent in a direction away from the discharge portion on the downstream side of the second supporting surface 103*b* in the transporting direction A.

As described above, when a plurality of recessed portions 125*a* are formed at a position of the discharge range 115 by being arranged side by side in the width direction B, the medium M is recessed corresponding to the recessed portion 125*a*, and ink is discharged onto the recessed medium M, and thus there is a case where a landing position of the ink shifts corresponding to the recess of the medium M and thus the image quality decreases. When the plurality of recessed portions 125*a* are periodically arranged side by side in the width direction B as in the printing apparatus of the reference example, there is a case where decrease in periodic image quality occurs by the landing positions of the ink being periodically shifted in the width direction B.

Furthermore, the downstream side in the transporting direction A of both the recessed portion 125*a* and the recessed portion 125*b* is closed. In other words, the end portion on the downstream side in the transporting direction A of the supporting surface 103 becomes a surface having the same height as the protrusion portion (rib) between the recessed portions 125 without forming the recessed portion 125. Therefore, even in a case where the medium M floats up by, for example, ink being discharged onto the medium M and the medium M being bulged, the floatation of the medium M is not configured to be capable of being effectively released to the downstream side in the transporting direction A. Accordingly, as illustrated in FIGS. 15 and 16, wrinkles L (line-like bulge) are likely to occur, wrinkles L are likely to grow, and the height of the wrinkle L is likely to be high. If the height of the wrinkle L increases, there is a concern that the wrinkle L and the discharge portion will interfere.

In this specification, "height" means the position in the direction intersecting with the supporting surface and is not limited to the position in the vertical direction.

On the other hand, as illustrated in FIG. 2, in the printing apparatus 1 of this example, at the position of the discharge range 15, as the supporting surface 3, there is provided a first supporting surface 3*a* having no unevenness in the width direction B. In a case where the first supporting surface 3*a* is a supporting surface having unevenness in the width direction B, the medium M is deformed along the unevenness of the supporting surface. By making the first supporting surface 3*a* to have a shape on which unevenness is not formed in the width direction B, in the printing apparatus 1 of this example, deformation of the medium M is configured so as to be capable of being suppressed along the first supporting surface 3*a* at the position of the discharge range 15.

Further, as illustrated in FIG. 2, the printing apparatus 1 of this example includes a second supporting surface 3*b* in which a plurality of recessed portions 25 are arranged side by side in the width direction B on the downstream side of the first supporting surface 3*a* in the transporting direction A as the supporting surface 3. Here, the downstream side in the transporting direction A of the recessed portion 25 is not closed but opened. When the downstream side in the transporting direction A of the recessed portion 25 is opened, in a case where the floatation of the medium M is generated, it is possible to effectively release the floatation of the medium M to the downstream side in the transporting direction A. Therefore, as illustrated in FIG. 4, even if the floatation of the medium M is generated, it is possible to suppress the growth of wrinkles L accompanying the floatation, and it is possible to suppress the height of the wrinkles L to a low level. As illustrated in FIG. 3, this is because that, by opening the downstream side of the recessed portion 25 in the transporting direction A, even if the floatation of the medium M is generated, the floatation thereof is continuously formed in the transporting direction A and the width direction B and a fine deformed shape T (see FIGS. 11 and 12) having a substantially rhomboid shape is formed, so that the medium can be crushed.

Next, the reason why the height of the wrinkles L can be suppressed in a case where the printing apparatus 1 of this example is used will be described.

Figure 5:
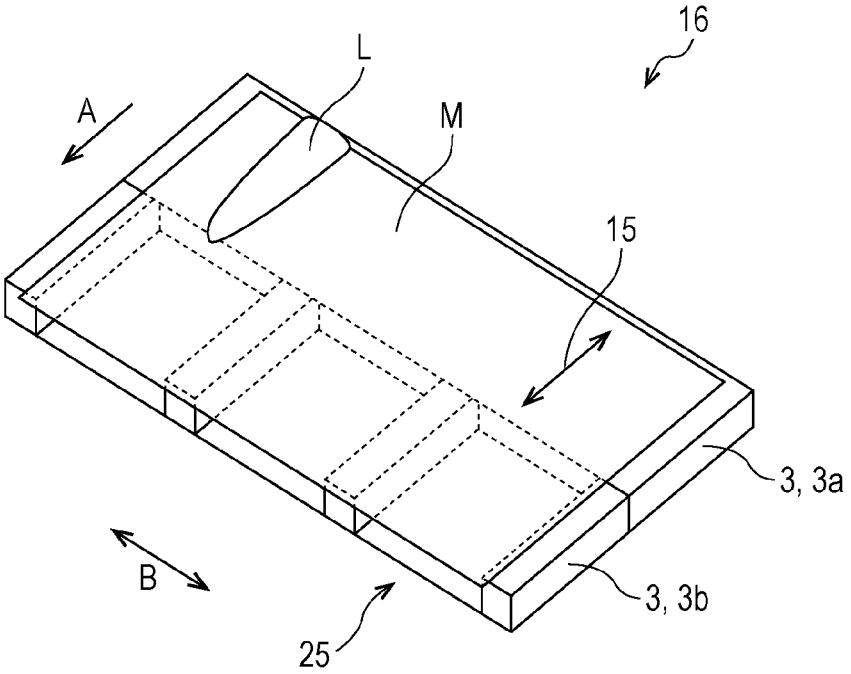
FIG. 5 is a schematic perspective view illustrating a main portion of the printing apparatus according to Example 1 of the invention.
Figure 6:
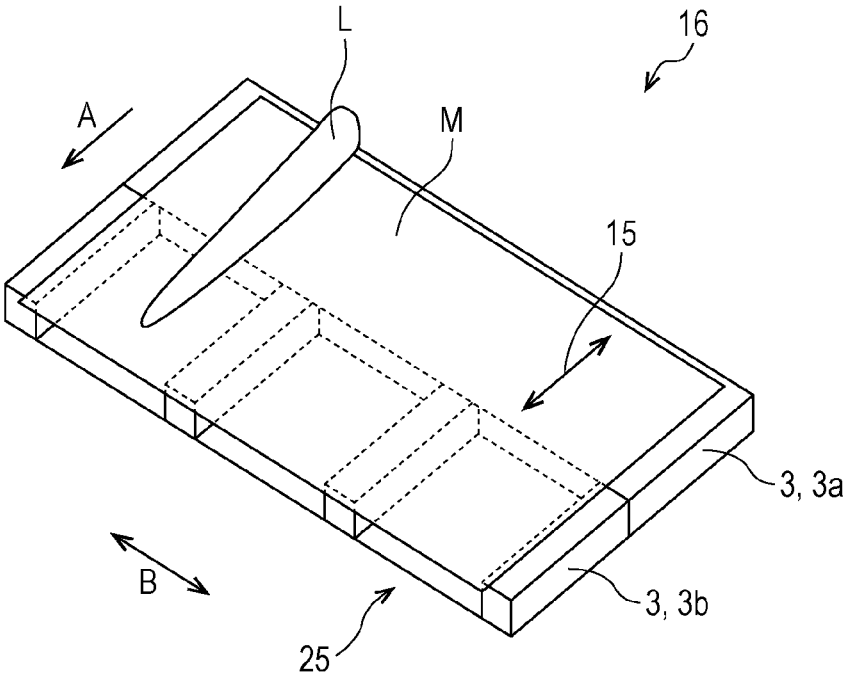
FIG. 6 is a schematic perspective view illustrating a main portion of the printing apparatus according to Example 1 of the invention.
Figure 7:
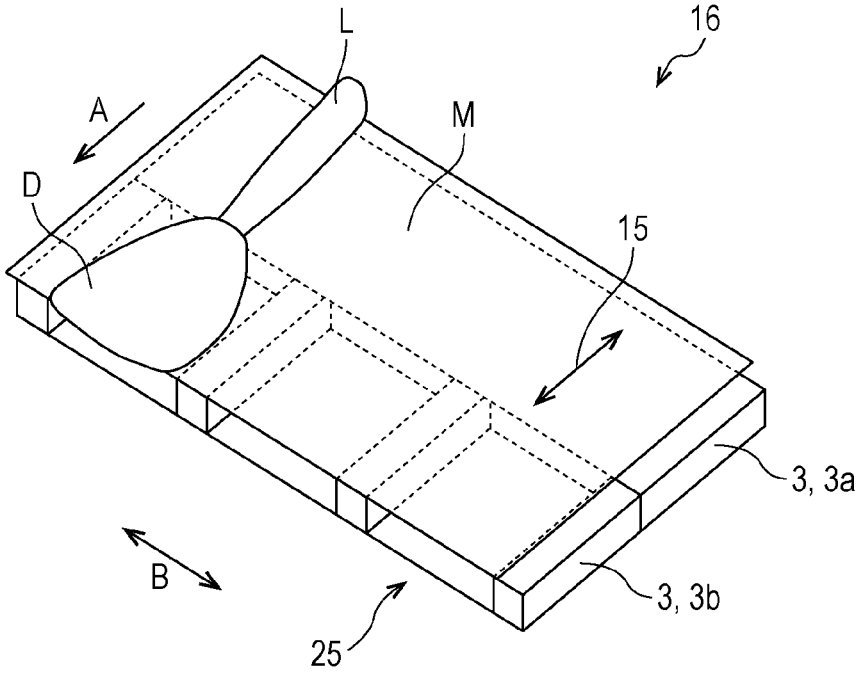
FIG. 7 is a schematic perspective view illustrating a main portion of the printing apparatus according to Example 1 of the invention.
Figure 8:
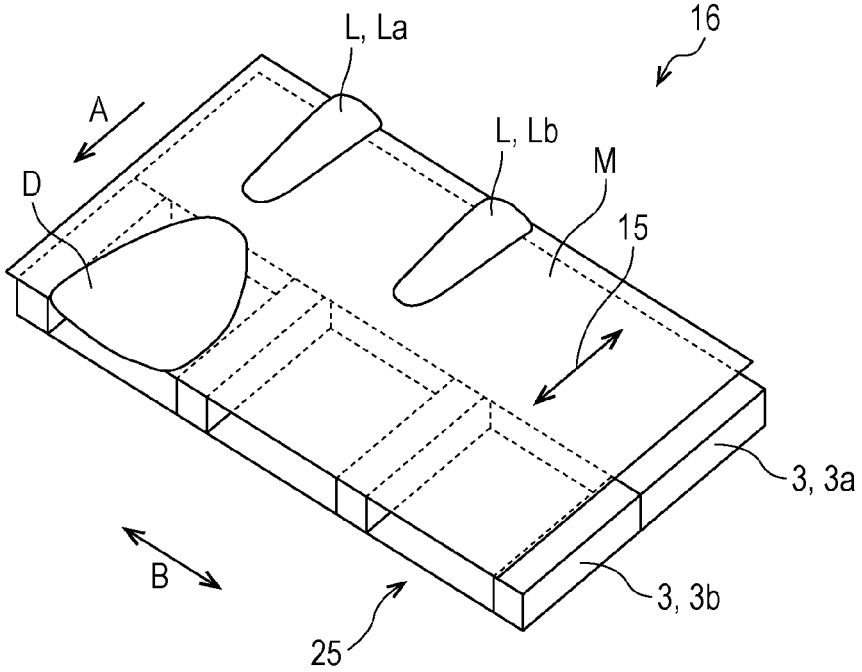
FIG. 8 is a schematic perspective view illustrating a main portion of the printing apparatus according to Example 1 of the invention.

Here, FIGS. 5 to 8 are schematic perspective views of the periphery of the discharge range 15 of the supporting portion 17, which is a main portion of the printing apparatus 1 of this example. Among the drawings, FIG. 5 illustrates a state where wrinkles L are generated in the medium M to be transported in the transporting direction A, FIG. 6 illustrates a state where wrinkles L generated on the medium M are grown, FIG. 7 illustrates a state where grown wrinkles L are crushed, and FIG. 8 schematically illustrates a state where wrinkles L are crushed and dispersed and suppressed to a low height.

Figure 9:
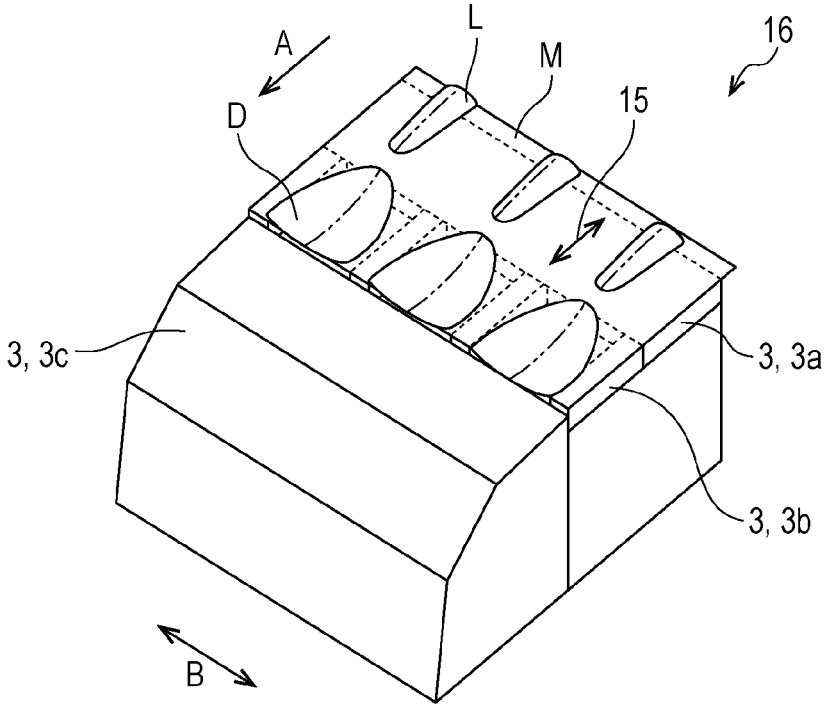
FIG. 9 is a perspective view illustrating a main portion of the printing apparatus according to Example 1 of the invention.
Figure 10:
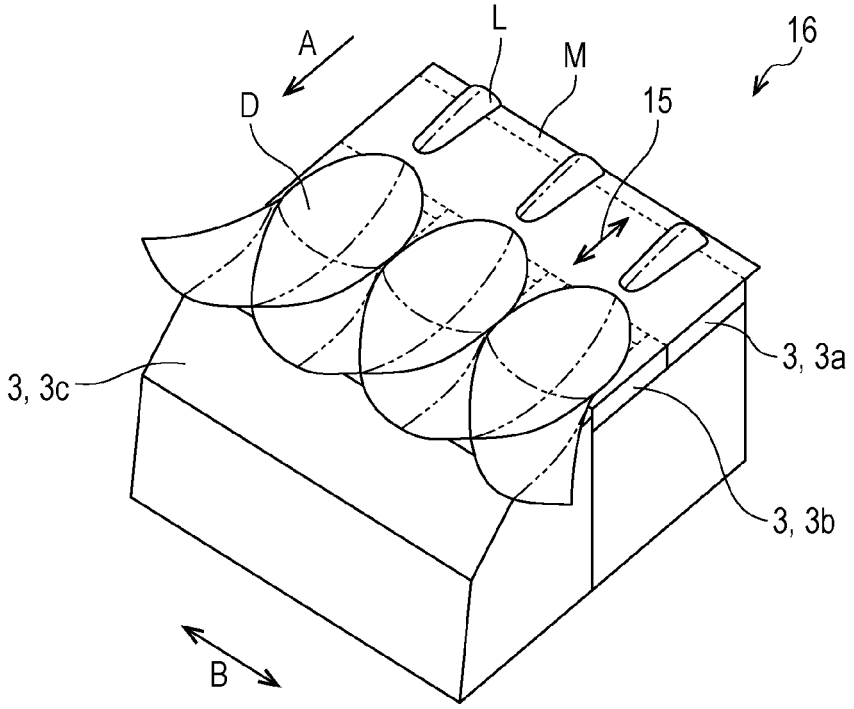
FIG. 10 is a perspective view illustrating a main portion of the printing apparatus according to Example 1 of the invention.
Figure 11:
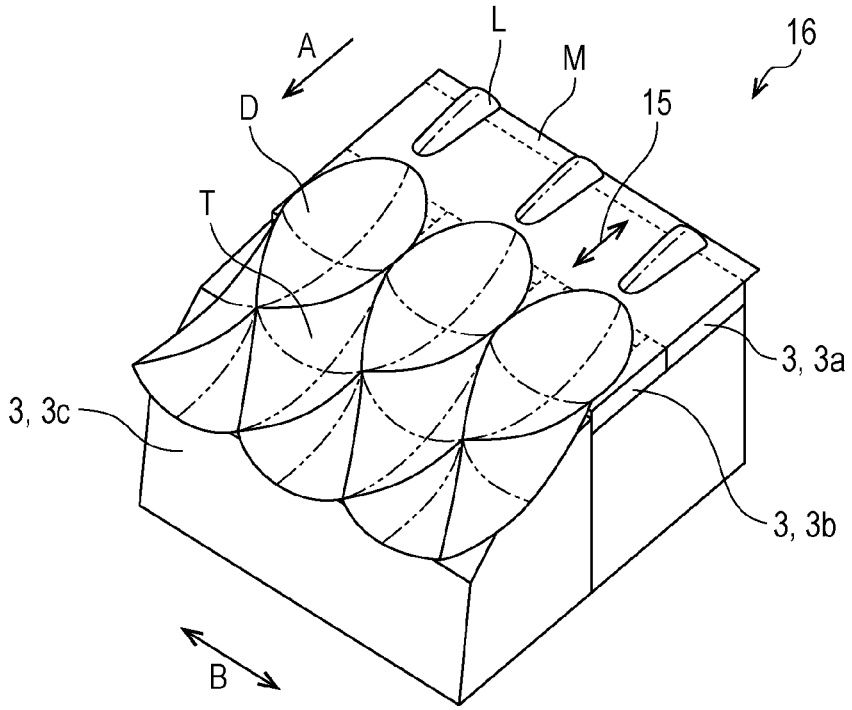
FIG. 11 is a perspective view illustrating a main portion of the printing apparatus according to Example 1 of the invention.
Figure 12:
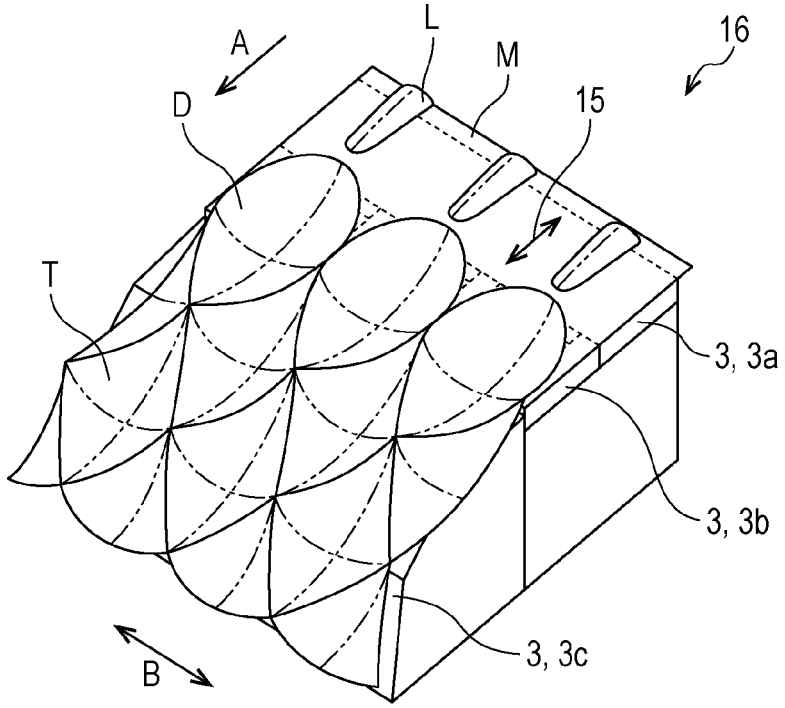
FIG. 12 is a perspective view illustrating a main portion of the printing apparatus according to Example 1 of the invention.

In addition, FIGS. 9 to 12 also illustrates a schematic perspective view illustrating the periphery of the discharge range 15 of the supporting portion 17 which is a main portion of the printing apparatus 1 of this example. Among the drawings, FIG. 9 schematically illustrates a state where wrinkles L are crushed and suppressed to a low height. In addition, FIGS. 10 to 12 schematically illustrate a state where the deformed shape T of the substantially rhombic shape spreads sequentially in the transporting direction A as the medium M is transported.

For example, when the ink is discharged onto the medium M, the medium M bulges and wrinkles L (floatation on medium M) may occur as illustrated in FIG. 5. Even in a case where the ink is not discharged onto the medium M, there is a case where the medium M sucks moisture in the atmosphere and thus wrinkles L are generated, a case where wrinkles L are generated due to uneven expansion of the medium M or the like due to heating of the medium M by the heater 12, or the like.

When wrinkles L occur on the medium M, there is a case where the wrinkles L grows. For example, in a state of being illustrated in FIG. 5, the wrinkle L is within the range of the first supporting surface 3*a*. However, in a state of being illustrated in FIG. 6, the wrinkle L reaches the second supporting surface 3*b*. As described above, when the wrinkle L grows, the height of the wrinkle L also tends to increase.

However, since the supporting surface 3 of this example includes the second supporting surface 3*b* having the recessed portion 25 on the downstream side in the transporting direction A relative to the first supporting surface 3*a*, as illustrated in FIG. 7, the wrinkle L is configured to be capable of being crushed by the recessed portion 25 of the second supporting surface 3*b*.

Then, when a recessed portion D formed by crushing the wrinkle L as illustrated in FIG. 7 is formed on the medium M, as illustrated in FIG. 8, the wrinkles L are dispersed in the wrinkles La and the wrinkles Lb and thus it is possible to decrease the height of the wrinkles L (wrinkles La and wrinkles Lb).

Further, as can be seen by sequentially referring to FIGS. 9, 10, 11, and 12, the deformed shape T of the substantially rhombic shape spreads in the transporting direction A. As described above, by forming a plurality of the deformed shapes T of the substantially rhombic shape in the transporting direction A and the width direction B, it is possible to suppress the growth of wrinkles L (keep height of wrinkles L low).

Here, as illustrated in FIG. 1, the printing apparatus 1 of this example includes a transporting roller pair 5 for transporting the medium M in the transporting direction A, and a head 4 for discharging ink to the medium M positioned in the discharge range 15. In addition, as illustrated in FIG. 2 and FIGS. 5 to 8, as the supporting surface 3 for supporting the medium M to be transported by the transporting roller pair 5, a supporting portion 17 having the first supporting surface 3*a* and the second supporting surface 3*b* is provided. Here, the first supporting surface 3*a* supports the medium M in the discharge range 15, and unevenness is not formed in the width direction B intersecting with the transporting direction A. As illustrated in FIG. 2, the second supporting surface 3*b* supports the medium M on the downstream side in the transporting direction A relative to the discharge range 15, and includes uneven portions 24 in which a protrusion portion 23 as a first portion and a recessed portion 25 further recessed than the protrusion portion 23 as a second protrusion portion are alternately formed in the width direction B.

As described above, the printing apparatus 1 of this example has the first supporting surface 3*a* that corresponds to the discharge range 15 and has no unevenness in the width direction B and the second supporting surface 3*b* in which the uneven portions 24 alternately formed in the width direction B. Therefore, the medium M supported by the first supporting surface 3*a* corresponding to the discharge range 15 can be kept flat while suppressing floatation of the medium M from the supporting surface 3 by the second supporting surface 3*b*. Therefore, in the printing apparatus 1 of this example, it is possible to suppress the floatation of the medium M to be transported from the supporting surface 3 and decrease in the image quality due to the deformation of the medium M.

Here, as described above, since the downstream side of the recessed portion 25 in the transporting direction A is opened, for example, by reducing the wrinkle L generated in the medium M, the floatation of the medium M can be released to the downstream side in the transporting direction A.

Since the supporting surface 3 of this example is provided with a second supporting surface 3*b* having a recessed portion 25 of which a downstream side thereof is opened on the downstream side in the transporting direction A with respect to the first supporting surface 3*a* in which unevenness is not formed in the width direction B, the floatation of the medium M can be particularly effectively released to the downstream side (for example, height of wrinkle L is lowered).

Here, if the supporting surface 3 is provided with the recessed portion 25 whose downstream side in the transporting direction A is opened, even if it is not provided with a region in which unevenness is not formed in the width direction B on the upstream side in the transporting direction A, the floatation of the medium M can be released to the downstream side in the transporting direction A.

The "downstream side is opened" means that it includes not only a structure which is nothing configured at the downstream side but also a structure having a structure object in a partial region on the downstream side, or a structure in which a structure having a structure object lower than the protrusion portion 23 on the entire downstream side, and the like, that is, it means that it can be a structure which can release the floatation of the medium M (for example, decrease in wrinkles L).

In addition, as illustrated in FIG. 2 and FIGS. 9 to 12, the printing apparatus 1 of this example has a third supporting surface 3*c* as a bent portion which is bent in a direction (downward direction) away from the head 4 on a downstream side of the recessed portion 25 in the transporting direction A in the transporting path 16 of the medium M.

With such a configuration, the printing apparatus 1 of this example bends the medium M along the third supporting surface 3*c* to crush the floatation of the medium M, and particularly effectively suppresses the floatation of the medium M.

In addition, as illustrated in FIG. 2, the length L2 in the width direction B of the recessed portion 25 in the printing apparatus 1 of this example is longer than the length L1 thereof in the transporting direction A. Therefore, in the printing apparatus 1 of this example, even in a case of using a medium M (such as a thick medium or a strongly elastic medium) hardly generating fine unevenness in the width direction B, the floatation of the medium M is effectively released so that the floatation of the medium M can be particularly effectively suppressed.

In addition, in the printing apparatus 1 of this example, the height of the protrusion portion 23 and the height of the first supporting surface 3*a* are flush with each other. For example, if the height of the protrusion portion 23 is made higher than the height of the first supporting surface 3*a*, the medium M to be transported is likely to be hooked between the first supporting surface 3*a* and the second supporting surface 3*b*. However, by making the height of the protrusion portion 23 and the height of the first supporting surface 3*a* be flush with each other (making heights thereof approximately the same), it is possible to suppress the hooking of the medium M and increase the difference in height between the protrusion portion 23 and the recessed portion 25. Therefore, it is possible to effectively release the floatation of the medium M and it is possible to particularly effectively suppress the floatation of the medium M.

In addition, as illustrated in FIG. 2, a groove portion 18 and a groove portion 19 extending in the width direction B are provided on the first supporting surface 3*a* of this example. A plurality of suction holes 20 are provided along the width direction B in the groove portion 18, and a plurality of suction holes 22 are provided in the groove portion 19 along the width direction B. Furthermore, a plurality of suction holes 21 are provided along the width direction B on the second supporting surface 3*b* of this example. The suction hole 21 provided in the second supporting surface 3*b* is larger than the suction hole 20 and the suction hole 22 provided in the first supporting surface 3*a*.

As described above, by forming the suction holes (suction holes 20, suction holes 21, and suction holes 22) for sucking the medium M on each of the first supporting surface 3*a* and the second supporting surface 3*b*, the first supporting surface 3*a* and the second supporting surface 3*b* effectively suppress the floatation of the medium M. In addition, since the suction holes 21 formed in the second supporting surface 3*b* are made larger than the suction holes 20 and the suction holes 22 formed in the first supporting surface 3*a*, floatation of the medium M is particularly effectively suppressed.

In addition, as illustrated in FIG. 2 and FIGS. 5 to 8, in the supporting surface 3 of this example, the first supporting surface 3*a* is adjacent to the uneven portion 24 of the second supporting surface 3*b* (portion configured with protrusion portion 23 and the recessed portion 25) in the transporting direction A. Therefore, the printing apparatus 1 of this example is configured that the floatation of the medium M can be released on the downstream side of the first supporting surface 3*a* immediately in the transporting direction A corresponding to the discharge range 15 and the floatation of the medium M can be particularly effectively suppressed.

However, the printing apparatus 1 of this example is not limited to such a configuration.

Figure 13:
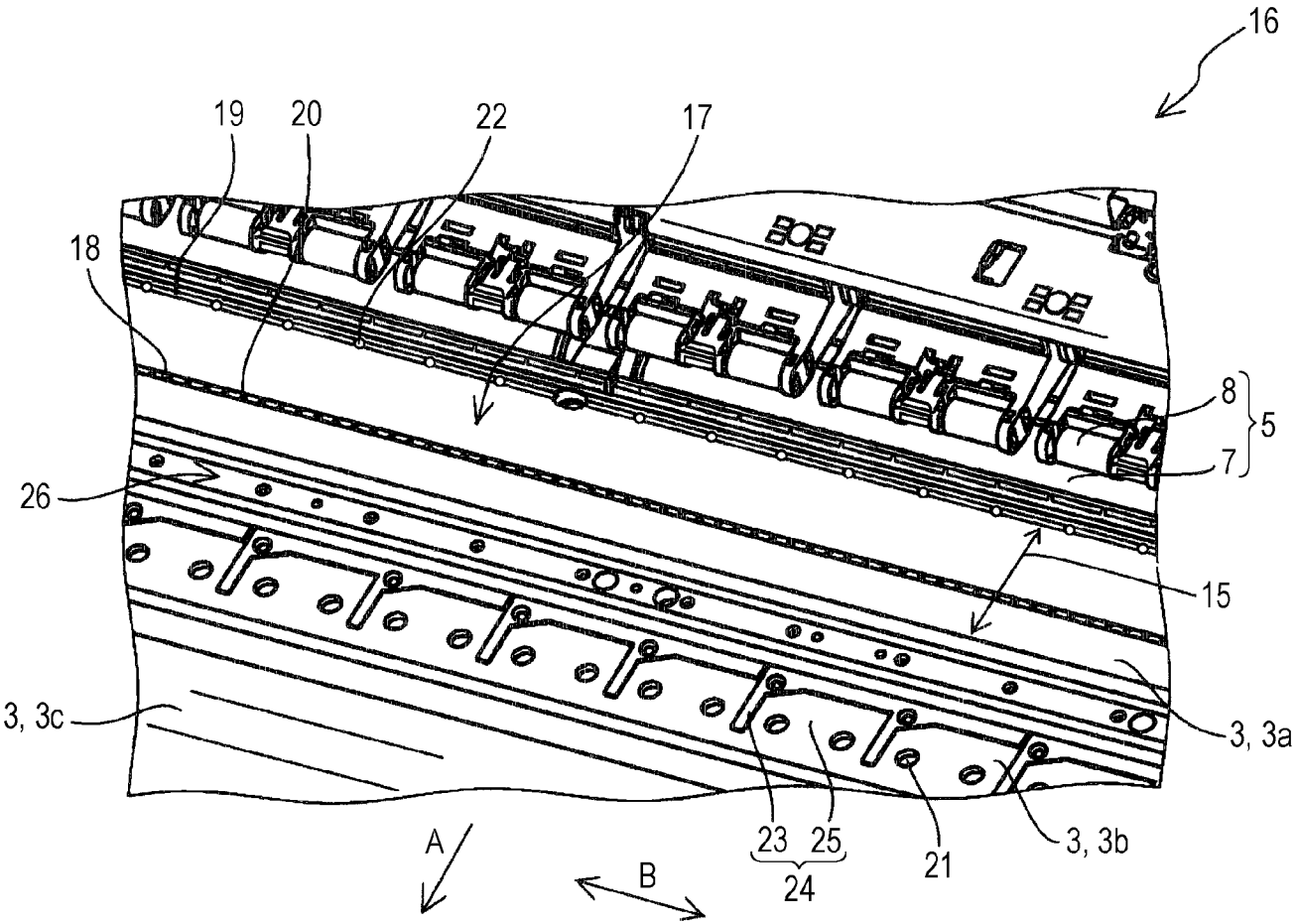
FIG. 13 is a perspective view illustrating the main portion of a printing apparatus according to Example 2 of the invention.

Example 2 (FIG. 13)

Hereinafter, Example 2 will be described in which the first supporting surface 3*a* is not adjacent to the uneven portion 24 of the second supporting surface 3*b* in the transporting direction A.

FIG. 13 is a perspective view illustrating the periphery of the discharge range 15 of the supporting portion 17 which is a main portion of the printing apparatus 1 of this example, and illustrates a state where the medium M is not set in the transporting path 16, and is a view corresponding to FIG. 2 of Example 1. Constituent members common to those of Example 1 are denoted by the same reference numerals, and a detailed description thereof will be omitted.

In the printing apparatus 1 of this example, the configurations other than the supporting surface 3 are the same configurations as those of the printing apparatus 1 of Example 1.

As illustrated in FIG. 13, in the supporting surface 3 of this example, a width detection area 26 for width detection for detecting the length of the medium M in the width direction B is formed, on a region between the first supporting surface 3*a* and the second supporting surface 3*b*. In the printing apparatus 1 of this example, a sensor (not illustrated) is provided at a position facing the width detection area 26 of the carriage 6, and as the carriage 6 moves in the width direction B, the sensor is configured to be capable of detecting the length of the medium M in the width direction B by detecting the end portion of the medium M in the width direction B. As described above, another region may be provided between the first supporting surface 3*a* and the second supporting surface 3*b*, and the first supporting surface 3*a* may be configured not to be adjacent to the uneven portion 24 of the second supporting surface 3*b* in the transporting direction A.

The invention is not limited to the examples described above, and various modifications are possible within the scope of the invention described in the claims, and needless to say, the various modifications are also included within the scope of the invention.

This application claims priority under 35 U.S.C. § 119 to Japanese Patent Application No. 2017-077036, filed Apr. 7 2017. The entire disclosure of Japanese Patent Application No. 2017-077036 is hereby incorporated herein by reference.

What is claimed is:

1. A liquid discharge apparatus comprising:

a transporting unit that transports a medium in a transporting direction;

a discharge portion that discharges a liquid to the medium positioned in a discharge range; and a supporting portion that has a first supporting surface and a second supporting surface, as a supporting surface supporting the medium to be transported by the transporting unit, wherein the first supporting surface supports the medium in the discharge range and does not have unevenness in a width direction intersecting the transporting direction, wherein the first supporting surface includes a groove that is substantially straight-line shaped extending across the width direction, and wherein the second supporting surface supports the medium on a downstream side of the discharge range in the transporting direction and includes uneven portions in which a first portion and a second portion which is further recessed than the first portion are formed alternately in the width direction, wherein the second portion of the second supporting surface is provided with a suction hole for sucking the medium.

2. The liquid discharge apparatus according to claim 1, wherein a downstream side of the second portion in the transporting direction is opened.

3. The liquid discharge apparatus according to claim 1, further comprising:

a bent portion which is bent in a direction away from the discharge portion on a downstream side of the second portion in the transporting direction in a transporting path of the medium.

4. The liquid discharge apparatus according to claim 1, wherein the length of the second portion in the width direction is longer than the length thereof in the transporting direction.

5. The liquid discharge apparatus according to claim 1, wherein the height of the first portion and the height of the first supporting surface are flush with each other.

6. The liquid discharge apparatus according to claim 1, wherein the first supporting surface is adjacent to the uneven portion in the transporting direction.

7. The liquid discharge apparatus according to claim 1, wherein the groove of the first supporting surface is also provided with a suction hole for sucking the medium, and wherein the suction hole formed in the second portion of the second supporting surface is larger than the suction hole formed in the groove of the first supporting surface.

* * * * *